US009303635B2

(12) United States Patent
Ueda

(10) Patent No.: US 9,303,635 B2
(45) Date of Patent: Apr. 5, 2016

(54) COMPRESSOR AND VACUUM MACHINE

(71) Applicant: SHINANO KENSHI CO., LTD., Ueda-shi, Nagano (JP)

(72) Inventor: Kazuhiro Ueda, Nagano (JP)

(73) Assignee: SHINANO KENSHI CO., LTD., Ueda-shi (JP)

( * ) Notice: Subject to any disclaimer, the term of this patent is extended or adjusted under 35 U.S.C. 154(b) by 266 days.

(21) Appl. No.: 13/895,932

(22) Filed: May 16, 2013

(65) Prior Publication Data

US 2013/0343925 A1 Dec. 26, 2013

(30) Foreign Application Priority Data

Jun. 21, 2012 (JP) ..... 2012-140149

(51) Int. Cl.

| | |
|---|---|
| ***F04B 27/04*** | (2006.01) |
| ***F04B 17/03*** | (2006.01) |
| ***F04B 17/00*** | (2006.01) |
| ***F04B 35/01*** | (2006.01) |
| ***F04B 37/04*** | (2006.01) |
| ***F04B 39/12*** | (2006.01) |

(52) U.S. Cl.

CPC ..... *F04B 17/00* (2013.01); *F04B 27/0404* (2013.01); *F04B 35/01* (2013.01); *F04B 37/04* (2013.01); *F04B 39/121* (2013.01)

(58) Field of Classification Search

CPC ..... F04B 27/00; F04B 27/02; F04B 27/04; F04B 27/0451; F04B 27/0465; F04B 27/0533; F04B 27/0428; F04B 27/0673; F04B 39/121; F04B 39/125; F04B 39/126; F04B 39/127; F04B 37/04; F04B 35/01; F04B 17/00; F04B 17/03; F04B 1/04; F04B 1/0404; F04B 27/0404; F16J 10/04; F01B 3/0029; F01B 31/28; F03C 1/0626; F03C 1/0628

USPC ..... 92/72; 417/273, 372, 410.1, 423.14

See application file for complete search history.

(56) References Cited

U.S. PATENT DOCUMENTS

| | | | | | |
|---|---|---|---|---|---|
| 263,989 | A * | 9/1882 | Sterne | 417/534 | |
| 1,654,893 | A * | 1/1928 | Meyers et al. | 417/273 | |
| 2,345,125 | A * | 3/1944 | Huber | 74/50 | |
| 7,959,415 | B2 * | 6/2011 | Schuetzle et al. | 417/273 | |
| 2005/0069431 | A1 * | 3/2005 | Leu | F04B 27/005 | 417/415 |
| 2013/0189132 | A1 * | 7/2013 | Okada | F04B 39/066 | 417/372 |

FOREIGN PATENT DOCUMENTS

| | | | |
|---|---|---|---|
| JP | A-59-141778 | | 8/1984 |
| JP | 08338369 | A * | 12/1996 |
| JP | 2004274907 | A * | 9/2004 |
| JP | A-2009-030462 | | 2/2009 |
| JP | B2-4872938 | | 2/2012 |

* cited by examiner

*Primary Examiner* — Devon Kramer
*Assistant Examiner* — Nathan Zollinger
(74) *Attorney, Agent, or Firm* — Oliff PLC

(57) ABSTRACT

A compressor includes a motor; a piston reciprocating by the motor; a crankcase comprising a wall portion formed with a communication hole, and the crankcase housing the piston; a cylinder body secured to an internal surface of the wall portion, the cylinder body and the wall portion defining a chamber, a capacity of the chamber increasing or decreasing by reciprocating the piston; and a cylinder head secured to an outer surface of the wall portion, and the cylinder head and the wall portion defining a flow path communicated with the chamber through the communication hole.

14 Claims, 7 Drawing Sheets

COMPRESSOR AND VACUUM MACHINE

CROSS-REFERENCE TO RELATED APPLICATION

This application is based upon and claims the benefit of priority of the prior Japanese Patent Application No. 2012-140149, filed on Jun. 21, 2012, the entire contents of which are incorporated herein by reference.

BACKGROUND (i) Technical Field

The present invention relates to a compressor and a vacuum machine.

(ii) Related Art

There is known a compressor and a vacuum machine where a piston reciprocates within a cylinder. Japanese Patent Application Publication No. 2009-30462 discloses such a compressor. In this patent Application Publication, plural pistons are housed in a crankcase, and plural cylinders corresponding to these plural pistons are provided within the crankcase.

For example, air discharged from the plural cylinders may be corrected by another member other than the cylinder or the crankcase, and the air may be discharged from a single outlet. For example, in the above patent document, the air discharged from each cylinder is introduced to a casing, and the corrected air is discharged from a single outlet provided in the casing. In another case, the air discharged from each cylinder may be corrected by a pipe or a tube. However, such a member is provided in addition to the crankcase and the cylinder, so that the whole size of the device is increased and the number of parts is also increased.

SUMMARY

According to an aspect of the present invention, there is provided a compressor including: a motor; a piston reciprocating by the motor; a crankcase comprising a wall portion formed with a communication hole, and the crankcase housing the piston; a cylinder body secured to an internal surface of the wall portion, the cylinder body and the wall portion defining a chamber, a capacity of the chamber increasing or decreasing by reciprocating the piston; and a cylinder head secured to an outer surface of the wall portion, and the cylinder head and the wall portion defining a flow path communicated with the chamber through the communication hole, wherein the wall portion comprises first and second wall portions adjacent to each other, the cylinder head comprises first and second cylinder heads secured to outer surfaces of the first and second wall portions, respectively, the flow path comprises: a first flow path defined by the first wall portion and the first cylinder head; and a second flow path defined by the second wall portion and the second cylinder head and communicated with the first flow path.

According to another aspect of the present invention, there is provided a vacuum machine including: a motor; a piston reciprocating by the motor; a crankcase comprising a wall portion formed with a communication hole, and the crankcase housing the piston; a cylinder body secured to an internal surface of the wall portion, the cylinder body and the wall portion defining a chamber, a capacity of the chamber increasing or decreasing by reciprocating the piston; and a cylinder head secured to an outer surface of the wall portion, and the cylinder head and the wall portion defining a flow path communicated with the chamber through the communication hole, wherein the wall portion comprises first and second wall portions adjacent to each other, the cylinder head comprises first and second cylinder heads secured to outer surfaces of the first and second wall portions, respectively, the flow path comprises: a first flow path defined by the first wall portion and the first cylinder head; and a second flow path defined by the second wall portion and the second cylinder head and communicated with the first flow path.

DETAILED DESCRIPTION

Figure 1:
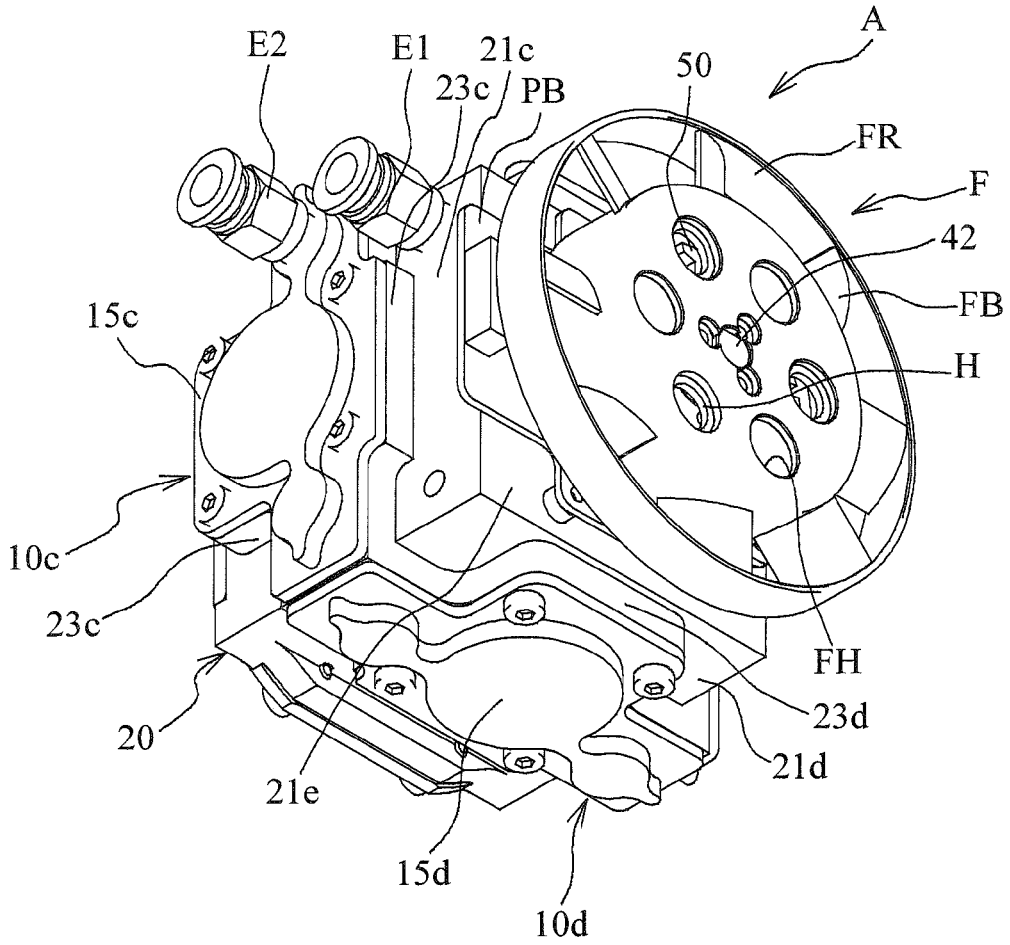
FIG. 1 is an external view of a compressor according to a present embodiment.
Figure 2:
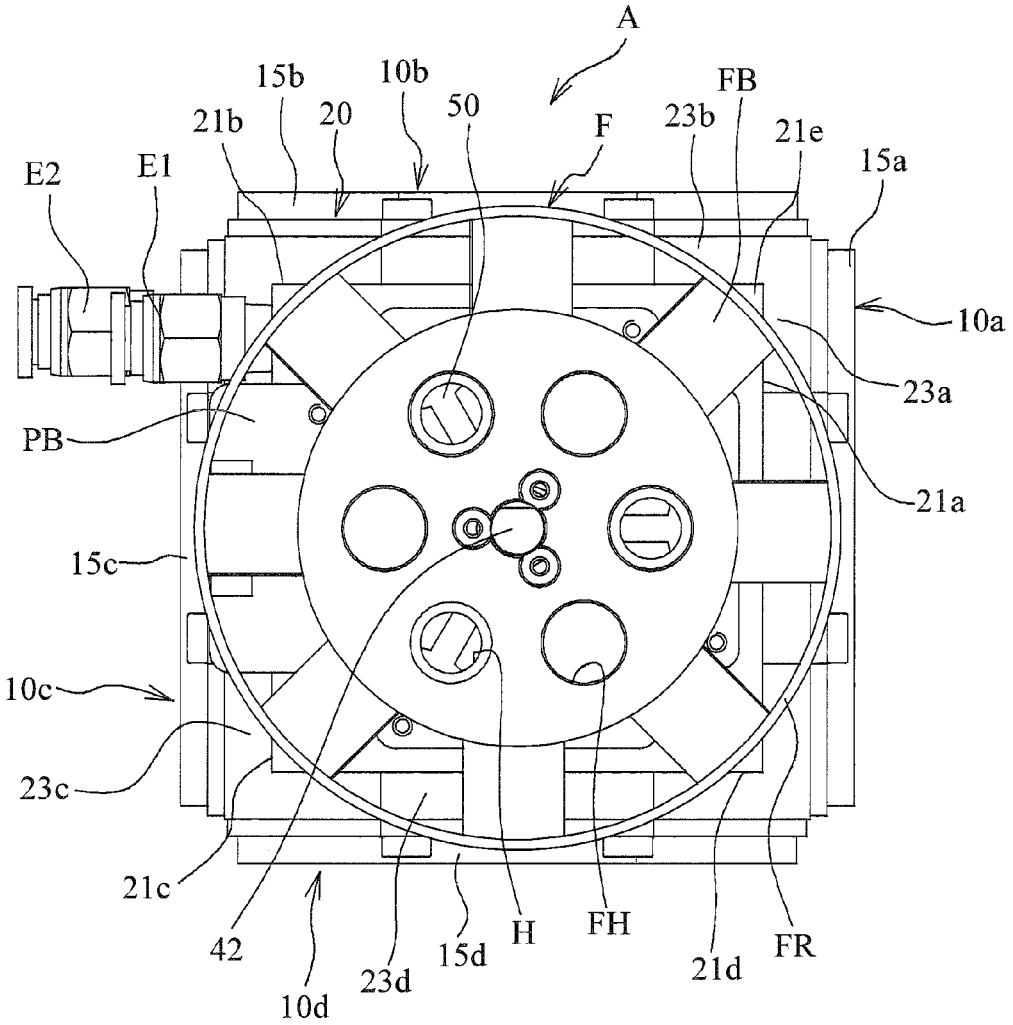
FIG. 2 is an external view of the compressor according to the present embodiment.
Figure 3:
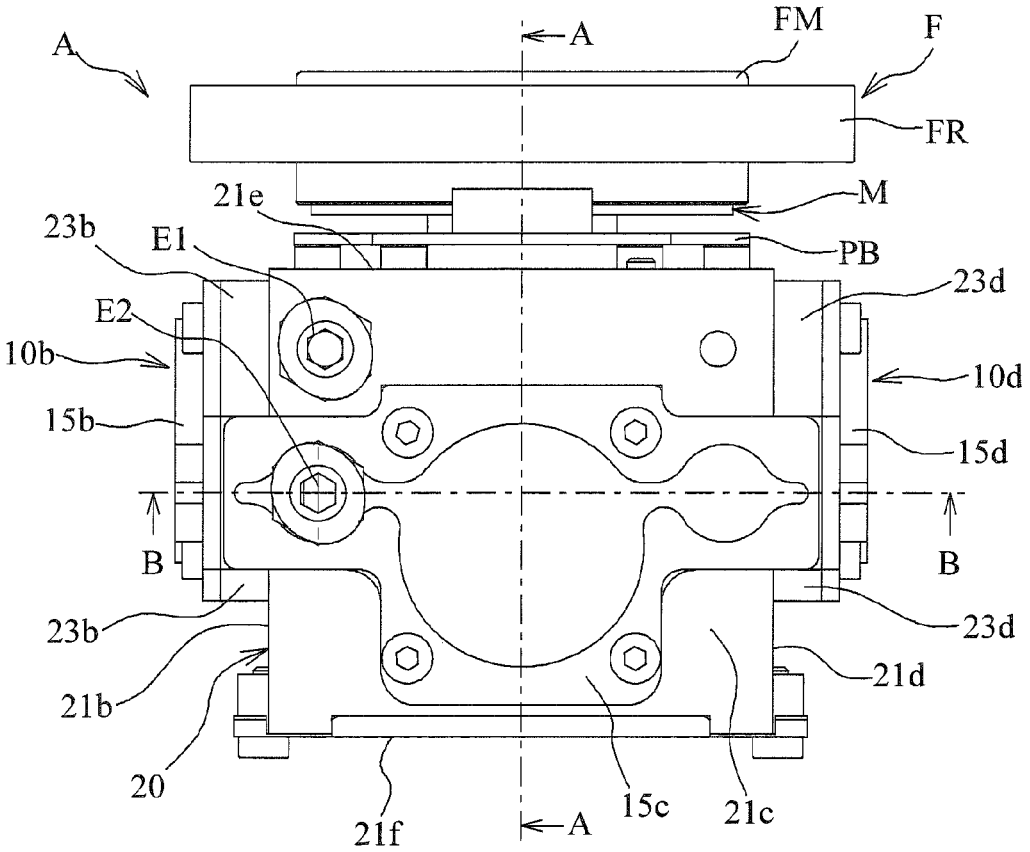
FIG. 3 is an external view of the compressor according to the present embodiment.

FIGS. 1 to 3 are external views of a compressor A according to a first embodiment. The compressor A includes: a crankcase 20; four cylinders 10*a* to 10*d* provided with the crankcase 20; and a fan F arranged at the upper side of the crankcase 20. The Fan F is secured to a motor. The motor will be described later in detail. The cylinder 10*a* includes a cylinder head 15*a* secured to the outside of the crankcase 20, and a cylinder body provided within the crankcase 20. Likewise, the other cylinders 10*b* to 10*d* have the same structure. Thus, the other cylinder heads 15*b* to 15*d* are provided on wall portions of the crankcase 20, respectively.

Specifically, the cylinder heads 15*a* to 15*d* are secured to wall portions 21*a* to 21*d* of the outer circumferential of the crankcase 20, respectively. As illustrated in FIG. 1, the cylinder heads 15*a* to 15*d* are radially arranged about the rotational shaft 42 at even intervals. The wall portions 21*a* and 21*b* are adjacent and perpendicular to each other, and the wall portion 21*c* and 21*d* are adjacent and perpendicular to each other. The wall portions 21*a* and 21*c* face each other in the parallel manner, and the wall portions 21*b* and 21*d* face each other in the parallel manner. Also, the crankcase 20 is provided with an upper wall portion 21*e* near the motor. The cylinder heads, the cylinder bodies, the crankcase 20 are made of metal such as aluminum having good heat radiation characteristics. Additionally, the wall portion 21*c* is provided with a nozzle E1 for introducing air into the crankcase 20, and the cylinder head 15*c* is provided with a nozzle E2 for discharging the air.

The fan F, which is secured to the motor, includes: a body portion FM having a substantially cylindrical shape; a ring portion FR formed at the outside of the body portion FM; and plural blade portions FB formed between the body portion FM and the ring portion FR. Rotation of the motor causes pistons to reciprocate within the crankcase 20 and causes the fan F to rotate, as will be described later in detail. This can cool the whole compressor A.

Figure 4:
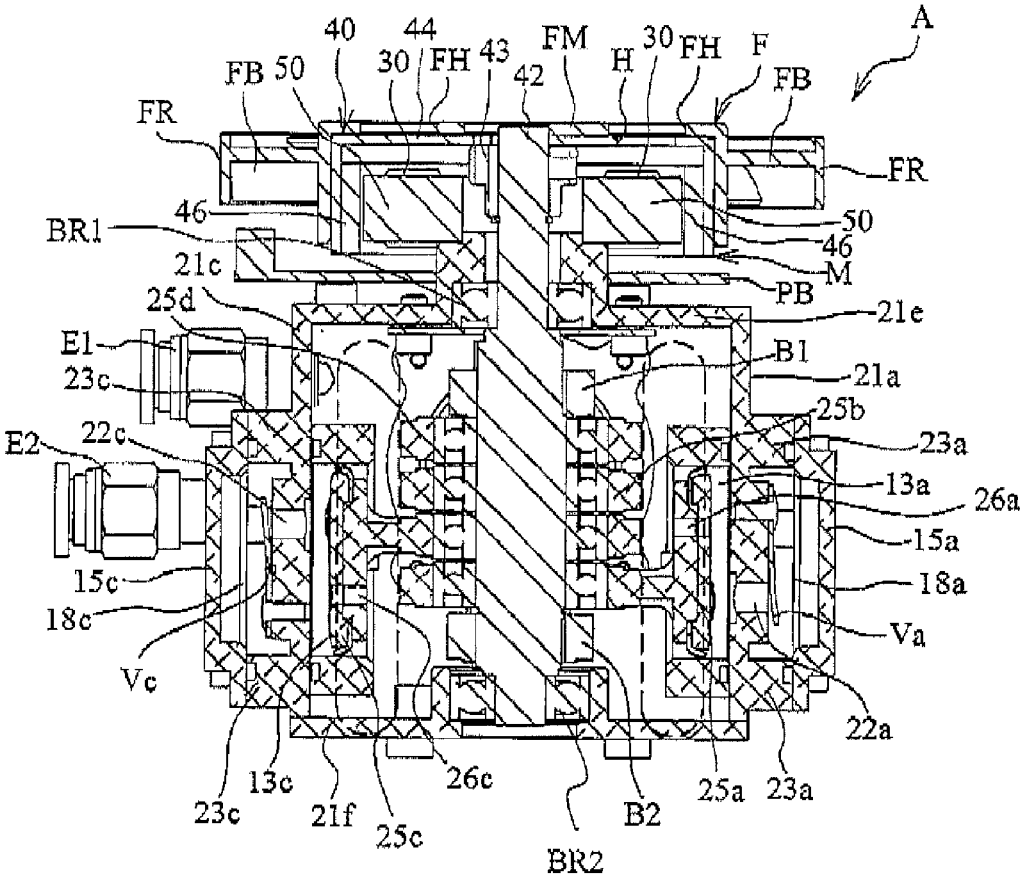
FIG. 4 is a sectional view taken along line A-A of FIG. 3.

FIG. 4 is a sectional view taken along line A-A of FIG. 3. Firstly, the motor M will be described. The motor M includes: coils 30, a rotor 40, a stator 50, and a printed circuit board PB. The stator 50 is made of metal. The stator 50 is secured to the crankcase 20. The plural coils 30 are wound around the stator 50. The coils 30 are electrically connected with the printed circuit board PB. As for the printed circuit board PB, conductive patterns are formed on an insulating board having rigidity. A non-illustrated power supply connector for supplying power to the coils 30, a signal connector, and other electronic parts are mounted on the printed circuit board PB. For example, the electronic part is an output transistor (a switching element) such as an FET for controlling an energized state of the coils 30, or a capacitor. The coils 30 are energized, so the stator 50 is energized.

The rotor 40 includes: a rotational shaft 42; a yoke 44; and one or plural permanent magnets 46. The rotational shaft 42 is rotationally supported by plural bearings BR1 and BR2 arranged within the crankcase 20. The yoke 44 is secured to the rotational shaft 42 through a hub 43, so the yoke 44 rotates together with the rotational shaft 42. The yoke 44 has a substantially cylindrical shape and is made of metal. One or plural permanent magnets 46 are secured to the inner circumferential side of the yoke 44. The permanent magnets 46 face the outer circumferential surface of the stator 50. The coils 30 are energized, so the stator 50 is energized. Thus, the magnetic attractive force and the magnetic repulsive force are generated between the permanent magnets 46 and the stator 50. This magnetic force allows the rotor 40 to rotate with respect to the stator 50. As mentioned above, the motor M is an outer rotor type motor in which the rotor 40 rotates.

A body portion FM of the fan F is secured to the yoke 44. Specifically, the body portion FM of the fan F is secured to the yoke 44 by press-fitting or engaging, but the secured manner is not limited to this. The body portion FM is provided with plural holes FH to reduce the weight thereof. Also, the yoke 44 is provided with holes H. The fan F is secured to the yoke 44 such that the holes H of the yoke 44 overlap the several holes FH of the fan F. This permits air to flow into the motor M through the holes H and FH. This can promote the heat radiation of the inside of the motor M, for example, the heat radiation of the coils 30. Also, the air which has flowed into the motor M through the holes H and FH partially flows toward the cylinder heads 15*a* to 15*d* and the crankcase 20 through clearances between the stator 50 and the permanent magnet 46. It is therefore possible to cool the compressor A which is heated by the sliding of the pistons and adiabatic compression of air. Additionally, the stator 50 is partially exposed from the holes H, as illustrated in FIGS. 1 and 2.

Next, the internal structure of the crankcase 20 will be described. The rotational shaft 42 extends within the crankcase 20. The plural pistons 25*a* to 25*d* are connected to a part of the rotational shaft 42 within the crankcase 20. The proximal end of the piston 25*a* is connected to the position through a bearing BR1/BR2 at a position eccentric to the center position of the rotational shaft 42. The rotation of the rotational shaft 42 in the single direction permits the piston 25*a* to reciprocate. Likewise, the other cylinders 10*b* to 10*d* and the other pistons 25*b* to 25*d* respectively moving therewithin have the same structure. The positional phase difference between the four pistons 25*a* to 25*d* is 90 degrees. The crankcase 20 is provided with a lower wall portion 21*f* at a side opposite to the motor M.

Cylinder bodies 12*a* and 12*c* are secured to the internal surfaces of the wall portions 21*a* and 21*c* of the crankcase 20, respectively. When the rotational shaft 42 rotates, the distal end of the piston 25*a* slides on the cylinder body 12*a*. Herein, a chamber 13*a* is defined by the distal end of the piston 25*a*, the cylinder body 12*a*, and the wall portion 21*a* of the crankcase 20. The capacity of the chamber 13*a* increases and decreases by the reciprocation of the piston 25*a*. Likewise, the other pistons and the other cylinder bodies are configured in the same manner.

As illustrated in FIGS. 1 to 4, a nozzle E1 is provided in the wall portion 21*c* of the crankcase 20. The nozzle E1 fits into a through-hole provided in the wall portion 21*c*. The reciprocation of the piston 25*a* permits air to be introduced into the crankcase 20 through the nozzle E1. The distal end of the piston 25*a* is provided with a communication hole 26*a* as illustrated in FIG. 4. The end surface of the distal end of the piston 25*a* is provided with a non-illustrated valve member for opening and closing the communication hole 26*a*. A flow path 18*a* is defined between the cylinder head 15*a* and the wall portion 21*a*. The chamber 13*a* and the flow path 18*a* are separated by the wall portion 21*a* formed with a communication hole 22*a* communicating the chamber 13*a* with the flow path 18*a*. The communication hole 22*a* is opened or closed by a valve member Va secured to the outer surface of the wall portion 21*a*. Likewise, the other cylinder heads 15*b* to 15*d* and the wall portions 21*b* to 21*d* are configured In the same manner. As depicted in the FIG. 4, a given piston is situated on the interior of the wall portions 21*a* to 21*d* and can therefore not enter the flow path on the exterior of the wall portions 21*a* to 21*d*.

The reciprocation of the piston 25*a* changes the capacity of the chamber 13*a*. In response to this, air is introduced to the chamber 13*a* through the communication hole 26*a* and is compressed within the chamber 13*a*. The compressed air is discharged into the flow path 18*a* through the communication hole 22*a*. The flow path 18*a* is defined by the outer surface of the wall portion 21*a* and the cylinder head 15*a*.

Specifically, projection portions 23*a* project from the outer surface of the wall portion 21*a*. The projection portions 23*a* includes upper and lower portions which sandwich the communication hole 22*a*. Two projection portions 23*a* are formed to extend around the rotational shaft 42 on the wall portion 21*a*. The cylinder head 15*a* is secured to the projection portions 23*a*.

Likewise, projection portions 23*c* project from the outer surface of the wall portion 21*c*, and the cylinder head 15*c* is secured to the projection portions 23*c* to define the flow path 18*c*. Likewise, the other wall portion and the other cylinder head define the same flow path, as will be described later in detail.

Likewise, the other cylinders 10*b* to 10*d* have the same structure. Thus, air introduced into the crankcase 20 through the nozzle E1 is compressed by the reciprocation of the pistons 25*a* to 25*d*, and is discharged outside the crankcase 20. Additionally, as illustrated in FIG. 4, balancers B1 and B2 are connected to the rotational shaft 42 within the crankcase 20.

As illustrated in FIG. 4, the cylinder body 12*a* is arranged within the crankcase 20, and the wall portion 21*a* of the crankcase 20 functions as a seating portion where that piston 25*a* is seated. Likewise, the other wall portions 21*b* to 21*d* function as seating portions on which the pistons 25*b* to 25*d* are seated, respectively. Additionally, in order to avoid collision noise in seating the piston, a slight gap may be made so as not to seat the piston completely. Thus, the compressor A is reduced in size in such a direction that the pistons 25*a* to 25*d* reciprocate, that is, in the direction perpendicular to the rotational shaft 42. This will be described below.

Figure 5:
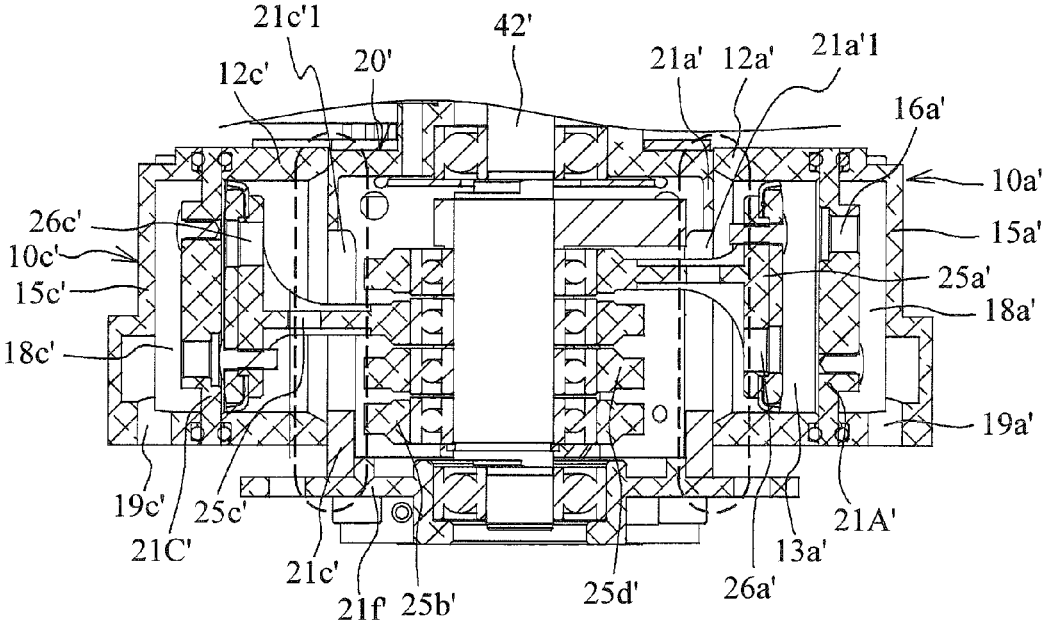
FIG. 5 is a partially sectional view of a compressor having a structure different from that of the present embodiment.

FIG. 5 is a explanatory view of an example of a compressor A' having the structure different from the compressor A according to the present embodiment. Additionally, in the compressor A', similar components of the compressor A according to the first embodiment are designated with similar reference numerals and a description of those components will be omitted. Also, FIG. 5 is a partially sectional view of the compressor A'. As illustrated in FIG. 5, as for the compressor A', a cylinder body 12*a*' is secured to an outer surface of a wall portions 21*a*' of a crankcase 20'. Also, a cylinder head 15*a*' is secured to the cylinder body 12*a*'. A partition member 21A' is provided between a chamber 13*a*' defined in the cylinder body 12*a*' side and an exhaust chamber 18*a*' defined in the cylinder head 15*a*' side. The partition member 21A' functions as a seating portion where the distal end of a piston 25*a*' is seated. Thus, the wall portions 21*a*' of the crankcase 20' and the partition member 21A' are arranged in the direction perpendicular to a rotational shaft 42'.

Also, a wall portions 21*c*' and a partition member 21C' are arranged in the same manner. The other wall portion and the other partition member are arranged in the same manner. For this reason, the compressor A' is increased in size in the direction perpendicular to the rotational shaft 42'.

However, in the present embodiment, the wall portions 21*a* to 21*d* of the crankcase 20 functions as the seating portions for the pistons 25*a* to 25*d*, respectively. Thus, the compressor A according to the present embodiment does not need the partition member 21A'. Thus, in the compressor A according to the present embodiment, the size is reduced in such directions that the pistons 25*a* to 25*d* reciprocate, and the number of the parts is reduced.

Also, in the compressor A' illustrated in FIG. 5, the wall portions 21*a*' and 21*c*' of the crankcase 20' are formed with cutout portions 21*a*'1 and 21*c*'1 having the size to escape axes of the pistons 25*a*' and 25*c*', respectively. Also, the other wall portions have cutout portions in the same manner. On the other hand, in the compressor A according to the present embodiment, although the wall portion 21*a* of the crankcase 20 is provided with the communication hole 22*a*, the wall portion 21*a* is not provided with such a large cutout portion 21*a*'1 formed in the wall portion 21*a*' of the compressor A'. Therefore, the hardness of the crankcase 20 is greater than that of the crankcase 20'. Thus, the durability of the crankcase 20 is improved. Also, the crankcase 20 has high hardness, so it is easy to process the crankcase 20.

In the compressor A', the above mentioned cutout portion 21*a*'1 is provided in the wall portion 21*a*' of the crankcase 20', and the cylinder body 12*a*' is secured to the outer surface of the wall portion 21*a*'. Therefore, air might leak from a gap between the wall portion 21*a*' and the cylinder body 12*a*', so that drive noise might occur. In the present embodiment, such a large cutout portion is not provided in the crankcase 20. It is thus possible to improve the airtightness of the crankcase 20 and to prevent air from leaking from the crankcase 20, thereby preventing the drive noise from occurring. Also, it is conceivable that a sealing member such as a rubber member is arranged so as to cover the gap in order to prevent air from leaking therefrom. However, such a rubber sealing member is arranged, so that the number of the parts is increased. In the crankcase 20 according to the present embodiment, there are few points where air might leak, as compared with the crankcase 20'. Thus, the number of such rubber seal members for preventing air from leaking is reduced.

Thus, the whole size of the compressor A is reduced. However, the crankcase 20 within which the cylinder body 12*a* and the like are provided is large, as compared with the size of the crankcase 20'. Therefore, each area of the wall portions 21*a* to 21*d* of the crankcase 20 is comparatively large. In the present embodiment, the wall portions 21*a* to 21*d* each having the large area are partially utilized to form the flow paths.

Further, the areas of the wall portions 21*a* to 21*d* are ensured, and also the areas of flat portions other than the flow paths are ensured. Thus, in the compressor A according to the present embodiment, the nozzle E1 is provided in this flat portion. Since the areas of the flat portions of the wall portions 21*a* to 21*d* are ensured in such a manner, the nozzle E1 may be provided at any position in the flat portions. This improves the flexibility of the position of the nozzle E1. Additionally, the position of the nozzle E1 is not limited to the position illustrated in the drawings. The nozzle E1 may be provided at an arbitrary position in the flat portions of the wall portions 21*a* to 21*f* including the upper and lower surfaces of the crankcase.

Also, the cooling effect by the fan F can be improved, since the areas of the flat portions of the wall portions 21*a* to 21*d* are ensured. Further, the flat portions of the wall portions 21*a* to 21*d* may be provided with a fin promoting the heat radiation of the crankcase 20. The flat portions can be effectively used in the above way.

Figure 6:
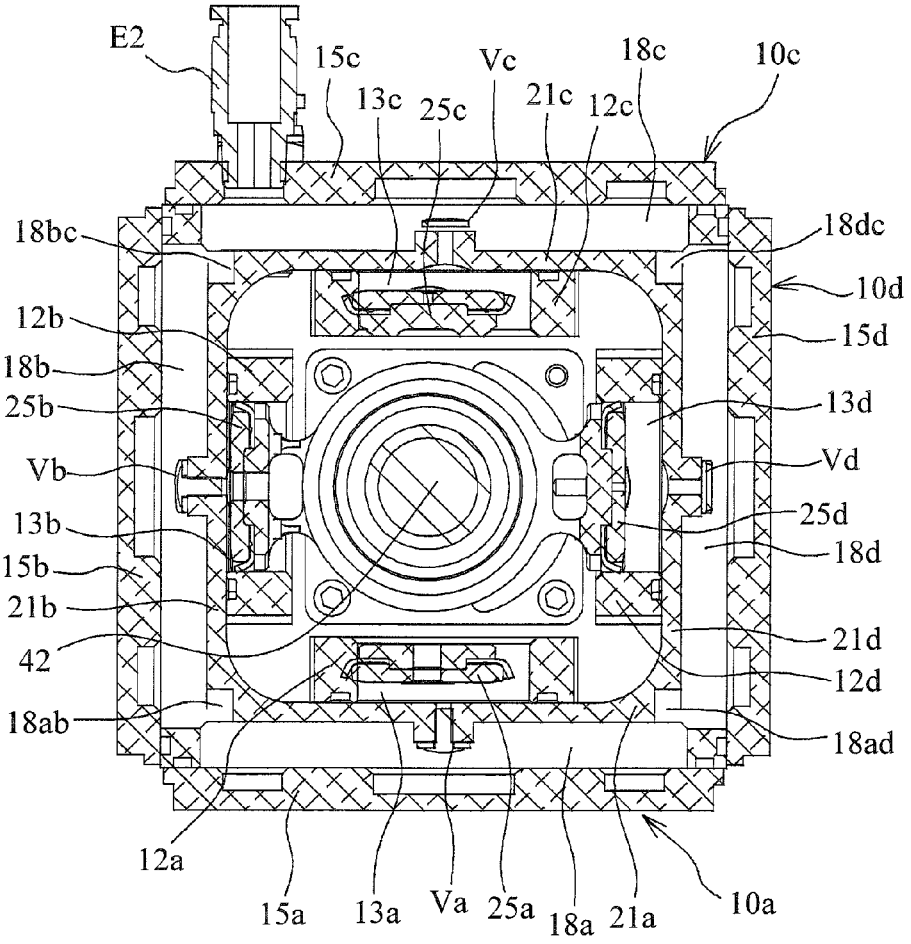
FIG. 6 is a sectional view taken along line B-B of FIG. 3.

FIG. 6 is a B-B sectional view taken along line B-B of FIG. 3. As illustrated in FIG. 6, the flow paths 18*a* to 18*d* are formed between the wall portions 21*a* to 21*d* and the cylinder heads 15*a* to 15*d*, respectively. These flow paths 18*a* to 18*d* are formed at the outer side of the wall portions 21*a* to 21*d* of the crankcase 20 so as to surround the rotational shaft 42. The flow paths 18*a* to 18*d* are communicated with one another through communication paths 18*ad*, 18*ab*, 18*bc*, and 18*dc* formed in the crankcase 20.

The communication path 18*ad* communicates between the flow paths 18*a* and 18*d*. The communication path 18*ab* communicates between the flow paths 18*a* and 18*b*. The communication path 18*bc* communicates between the flow paths 18*b* and 18*c*. The communication path 18*dc* communicates between the flow paths 18*d* and 18*c*. These communication paths 18*ad*, 18*cd*, 18*bc*, and 18*dc* are provided at corners portion of the crankcase 20, respectively.

Figure 7:
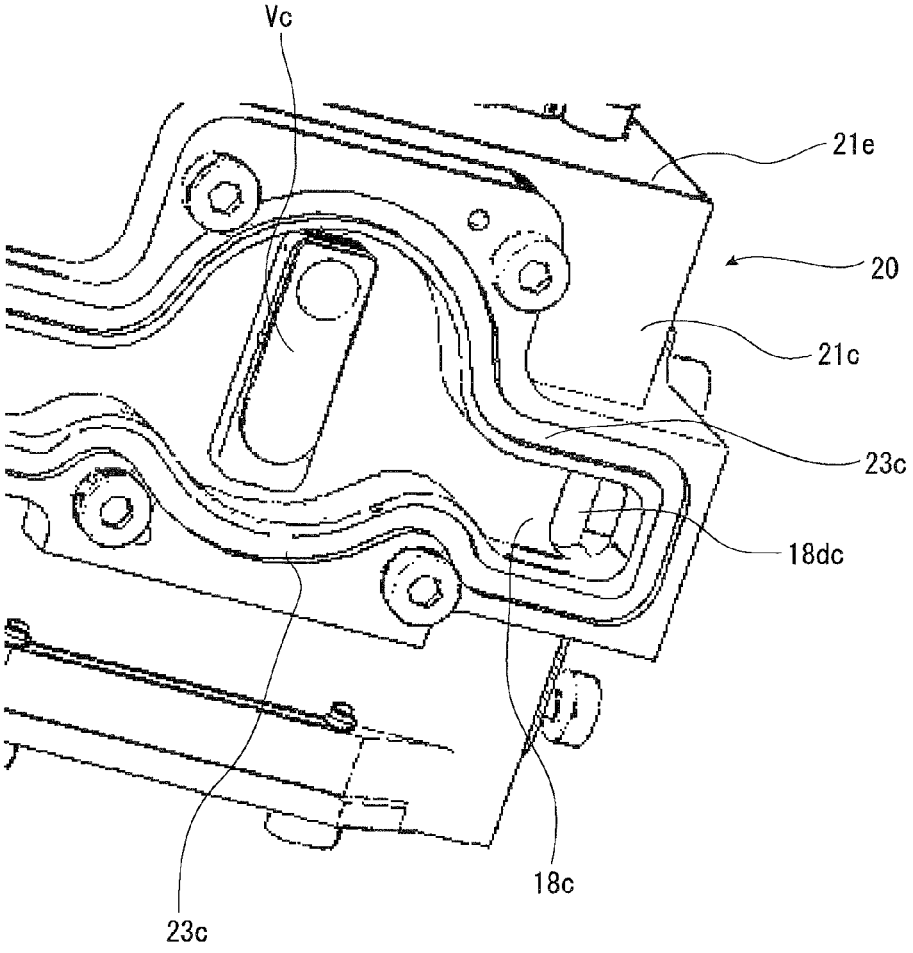
FIG. 7 is a partially enlarged view around a communication path of a crankcase.

FIG. 7 is a partial enlarged view around the communication path 18*dc* of the crankcase 20. FIG. 7 illustrates the state where the cylinder heads 15*c* and 15*d* are removed. Illustrating the communication path 18*dc*, the corner portion of the crankcase 20 is cutout so as to communicate between the flow paths 18*c* and 18*d*. The other communication paths 18*ab*, 18*ad*, and 18*bc* have the same structure.

In this manner, the plural flow paths 18*a* to 18*d* joined to one another are defined between the outer surfaces of the crankcase 20 and the plural cylinder heads 15*a* to 15*d*, respectively. Thus, another member such as a pipe or a tube for joining these flow paths 18*a* to 18*d* to one another is not needed. It is therefore possible to reduce the size of the compressor A according to the present embodiment and reduce the number of parts.

In addition, when the motor M drives and the pistons 25*a* to 25*d* drive, air flows from one of the adjacent flow paths toward the other one thereof through the communication path. For example, air flows into the flow path 18*c* from the flow path 18*d* through the communication path 18*dc*.

Also, the motor M is the outer rotor type motor. The outer rotor type motor tends to have a torque higher than that of an inner rotor type motor, providing that they have the same size. In other words, if the outer rotor type motor has the same output as an inner rotor type motor, the outer rotor type motor can be made smaller. Thus, the motor M of the compressor A according to the present embodiment is made small.

Also, the fan F is secured to the yoke 44 of the motor M. The compressor A is reduced in size in the axial direction of the rotational shaft 42, for example, as compared with a case where the fan is arranged such that the fan and the motor M sandwich the crankcase 20.

The Fan F is made of synthetic resin. The Yoke 44 where the fan F is secured is made of metal. The attenuation rate of the vibration of the fan F is greater than that of the rotor 40. It is therefore possible to reduce the drive noise of the compressor A. Further, the ring portion FR is provided at the ends of the plural blades FB to prevent an operator from touching the ends of the blades FB and getting injured. Also, it is preferable that the diameter of the fan F should be bigger than the surface of the compressor perpendicular to the rotational shaft 42.

As mentioned above, the compressor A is reduced in size, since the cylinder body 12*a* is secured to the internal surface of the wall portion 21*a* of the crankcase 20, the cylinder head 15*a* is secured to the outer surface of the wall portion 21*a*, the flow paths 18*a* to 18*d* are communicated through the communication paths 18*ad*, 18*ab*, 18*bc*, and 18*dc* formed in the crankcase 20, the outer rotor type motor M is employed, and the fan F is secured to the yoke 44 of the motor M.

Also, in the compressor A, the drive noise is reduced, since the airtightness of the crankcase 20 is improved, and the attenuation rate of the fan F is greater than that of the rotor 40.

Additionally, when the object device is connected at the intake side of the compressor A or when a check valve is arranged in a manner opposite to a manner of the compressor A, the compressor A acts as a vacuum machine.

Also, in another case where the compressor A is used as a vacuum machine, the object device is connected to the nozzle E1. In this case, the valve member provided within the cylinder 10*a* may be the same as the compressor A.

While the exemplary embodiments of the present invention have been illustrated in detail, the present invention is not limited to the above-mentioned embodiments, and other embodiments, variations and modifications may be made without departing from the scope of the present invention.

The above embodiment is an example of the configuration where four pairs of the cylinder and the piston are provided. However, the present invention is not limited to this configuration. For example, one, two, or three pairs of the cylinder and the piston may be provided. More than four pairs of the cylinder and the piston may be provided.

What is claimed is:

1. A compressor comprising:

a motor having a rotational shaft;

a piston reciprocating by the motor;

a crankcase comprising:

a first wall portion, a second wall portion, a third wall portion and a fourth wall portion that surround the rotational shaft, and an upper wall portion and a lower wall portion that respectively hold first bearings and second bearings, the first wall portion, the second wall portion, the third wall portion and the fourth wall portion being formed with a first communication hole, a second communication hole, a third communication hole, a fourth communication hole, respectively, the crankcase housing the piston;

a printed circuit board between the motor and the crankcase exposed to an outside of the compressor;

a first cylinder body secured to an internal surface of the first wall portion, a second cylinder body secured to an internal surface of the second wall portion, a third cylinder body secured to an internal surface of the third wall portion, and a fourth cylinder body secured to an internal surface of the fourth wall portion, the first cylinder body, the second cylinder body, the third cylinder body, the fourth cylinder body, the first wall portion, the second wall portion, the third wall portion and the fourth wall portion defining a chamber, a capacity of the chamber increasing or decreasing by reciprocating the piston; and a first cylinder head secured to an outer surface of the first wall portion, a second cylinder head secured to an outer surface of the second wall portion, a third cylinder head secured to an outer surface of the third wall portion and a fourth cylinder head secured to an outer surface of the fourth wall portion, the first cylinder head and the first wall portion defining a first flow path communicated with the chamber through the first communication hole, the second cylinder head and the second wall portion defining a second flow path communicated with the chamber through the second communication hole, the third cylinder head and the third wall portion defining a third flow path communicated with the chamber through the third communication hole, the fourth cylinder head and the fourth wall portion defining a fourth flow path communicated with the chamber through the fourth communication hole, wherein the first wall portion and the second wall portion are adjacent to each other, the piston does not enter any of the first flow path, the second flow path, the third flow path and the fourth flow path, and the first flow path and the second flow path are directly connected to and communicate with each other.

2. The compressor of claim 1, wherein the crankcase is formed with a communication path communicating between the first and second flow paths, and reciprocation of the piston permits air to flow from one of the first and second flow paths toward the other of the first and second flow paths through the communication path.

3. The compressor of claim 1, wherein a part of the first wall portion which is not provided with the first flow path is provided with an air hole communicating between inside and outside of the crankcase.

4. The compressor of claim 1, wherein the motor is an outer rotor type motor arranged outside of the crankcase.

5. The compressor of claim 4, wherein an outer rotor of the motor is provided with a fan.

6. The compressor of claim 5, wherein the fan is radially arranged about the outer rotor.

7. The compressor of claim 5, wherein the fan is secured to a yoke of the outer rotor, and each of the fan and the yoke is provided with a hole permitting air to flow from the outside of the motor to the inside of the motor.

8. A vacuum machine comprising:

a motor having a rotational shaft;

a piston reciprocating by the motor;

a crankcase comprising:

a first wall portion, a second wall portion, a third wall portion and a fourth wall portion that surround the rotational shaft, and an upper wall portion and a lower wall portion that respectively hold first bearings and second bearings, the first wall portion, the second wall portion, the third wall portion and the fourth wall portion being formed with a first communication hole, a second communication hole, a third communication hole, a fourth communication hole, respectively, the crankcase housing the piston;

a printed circuit board between the motor and the crankcase exposed to an outside of the vacuum machine;

a first cylinder body secured to an internal surface of the first wall portion, a second cylinder body secured to an internal surface of the second wall portion, a third cylinder body secured to an internal surface of the third wall portion, and a fourth cylinder body secured to an internal surface of the fourth wall portion, the first cylinder body, the second cylinder body, the third cylinder body, the fourth cylinder body, the first wall portion, the second wall portion, the third wall portion and the fourth wall portion defining a chamber, a capacity of the chamber increasing or decreasing by reciprocating the piston; and a first cylinder head secured to an outer surface of the first wall portion, a second cylinder head secured to an outer surface of the second wall portion, a third cylinder head secured to an outer surface of the third wall portion and a fourth cylinder head secured to an outer surface of the fourth wall portion, the first cylinder head and the first wall portion defining a first flow path communicated with the chamber through the first communication hole, the second cylinder head and the second wall portion defining a second flow path communicated with the chamber through the second communication hole, the third cylinder head and the third wall portion defining a third flow path communicated with the chamber through the third communication hole, the fourth cylinder head and the fourth wall portion defining a fourth flow path communicated with the chamber through the fourth communication hole, wherein the first wall portion and the second wall portion are adjacent to each other, the piston does not enter any of the first flow path, the second flow path, the third flow path and the fourth flow path, and the first flow path and the second flow path are directly connected to and communicate with each other.

9. The vacuum machine of claim 8, wherein the crankcase is formed with a communication path communicating between the first and second flow paths, and reciprocation of the piston permits air to flow from one of the first and second flow paths toward the other of the first and second flow paths through the communication path.

10. The vacuum machine of claim 8, wherein a part of the first wall portion which is not provided with the first flow path is provided with an air hole communicating between inside and outside of the crankcase.

11. The vacuum machine of claim 8, wherein the motor is an outer rotor type motor arranged outside of the crankcase.

12. The vacuum machine of claim 11, wherein an outer rotor of the motor is provided with a fan.

13. The vacuum machine of claim 12, wherein the fan is radially arranged about the outer rotor.

14. The vacuum machine of claim 12, wherein the fan is secured to a yoke of the outer rotor, and each of the fan and the yoke is provided with a hole permitting air to flow from the outside of the motor to the inside of the motor.

* * * * *